United States Patent [19]

Bowman

[11] Patent Number: 4,601,462

[45] Date of Patent: Jul. 22, 1986

[54] BOOK MAKING APPARATUS AND METHOD WITH DIVERTOR BETWEEN BINDARIES

[75] Inventor: Kenneth A. Bowman, Bristol, England

[73] Assignee: DRG (UK) Limited, Bristol, England

[21] Appl. No.: 627,909

[22] Filed: Jul. 3, 1984

[30] Foreign Application Priority Data

Jul. 7, 1983 [GB] United Kingdom ..... 8318465

[51] Int. Cl.[4] ..... B41F 13/64

[52] U.S. Cl. ..... 270/12; 270/53

[58] Field of Search ..... 270/1.1, 4, 5, 10–12, 270/15, 18, 54–55, 58, 53, 1; 412/8, 33

[56] References Cited

U.S. PATENT DOCUMENTS

| | | | |
|---|---|---|---|
| 2,873,113 | 2/1959 | McWhorter | 270/12 |
| 3,881,716 | 5/1975 | Bryson et al. | 270/12 |
| 3,977,665 | 8/1976 | Bowman et al. | 270/4 |
| 4,025,065 | 5/1977 | Timson | 270/12 |
| 4,155,133 | 5/1979 | Timson | 270/54 X |
| 4,179,107 | 12/1979 | Harris | 270/18 |
| 4,234,178 | 11/1980 | Beckert et al. | 270/12 |
| 4,273,319 | 6/1981 | Stocker | 270/58 X |

FOREIGN PATENT DOCUMENTS

| | | | |
|---|---|---|---|
| 16260 | 1/1980 | European Pat. Off. | 270/54 |
| 2824933 | 12/1979 | Fed. Rep. of Germany | 270/12 |
| 1462072 | 1/1977 | United Kingdom | 270/18 |

*Primary Examiner*—E. H. Eickholt

*Attorney, Agent, or Firm*—Larson and Taylor

[57] ABSTRACT

Apparatus for producing large books includes two apparatuses which may be used independently to produce normal books. Each has a printing press for producing signatures, and a bindery. A diverting device is operable to take the output of the first press and combine it with the output of the second press. Thus different halves of a large book may be printed by the two presses and then combined.

2 Claims, 4 Drawing Figures

BOOK MAKING APPARATUS AND METHOD WITH DIVERTOR BETWEEN BINDARIES

BACKGROUND OF THE INVENTION

This invention relates to a method and apparatus for use in the production of books.

U.K. patent specification No. GB-A-1473502 describes a book production method which is a continuous process from the operation of the printing press through compilation of a batch of signatures ready for binding together to form one or more books. In the system described in that specification, the batches of signatures are printed "two-up", in a "come and go" format. That is, in the example described in that specification, each batch of signatures can be considered as having two distinct halves, each half having half the number of pages required to make up the book. Two such batches are then placed together face to face, one batch having been rotated through 180° with respect to the other. This pair of batches of signatures is then bound, and sawn in half to produce two identical complete books. The advantage of such a two-up, come and go process is that since the bindery is binding two books at a time, its output is doubled, while at the same time the printing cylinders of the press do not need to have expensive duplicate plates for each page of the book, and are easy and quick to set up. Traditionally, such two-up, come and go processes involved manual rotation of batches of signatures or of individual signatures before the signatures are bound, and specification No. GB-A-1473502 is directed to automating that process.

In such a machine, it is nevertheless economic to have duplicate printing plates for each page of the book and to print "straight" rather than "come and go", if the number of pages in the particular book being printed is less than half the capacity of the press. Clearly, it is then no longer necessary to rotate half the batches of signatures through 180°.

A problem arises, however, if it is desired to print a relatively large book having more pages than the capacity of the press. On the above prior art system, the only way of printing such books with many pages would be to install a press having a sufficiently large capacity. Of course, such a large capacity press would be more expensive, and would be uneconomic because most books do not have a large number of pages and so the large capacity of the press would be underused for perhaps 90% of print runs.

It is therefore desirable to have a system which can produce such books with a large number of pages. At the same time, it is desirable to have a system which is sufficiently flexible to remain economic for print runs with a smaller number of pages.

SUMMARY OF THE INVENTION

The present invention provides apparatus for making books, comprising a pair of printing presses adapted for producing signatures; and a pair of binderies, one associated with each press, and adapted to bind the signatures produced by the respective press into books; characterised in that diverting means is provided, arranged when operative to divert the output of a first said press and combine it with the output of the second said press and to feed the combined output to the bindery associated with the second press. For books with a relatively small number of pages, therefore, each press and its associated bindery can be operated independently and efficiently; while for books with a larger number of pages the outputs of the two presses can be combined and bound together.

Preferably, there is a collating means associated with each press, arranged to collate the signatures into batches prior to binding. Preferably, the diverting means is arranged downstream of the collating means.

Preferably, the apparatus is arranged for a come and go process, and each press has associated therewith means for combining pairs of batches of signatures, one batch of the pair being rotated through 180° with respect to the other. It is preferred that such combining means for come and go operation should be downstream of the diverting means, although this is not essential.

The present invention also provides a method of making books on apparatus as defined above, in which half the signatures of the required book are printed on one press and half on the other, one half then being diverted by the diverting means and combined with the other half, and the combined halves then being bound together in the bindery associated with the second press. (It will be appreciated that the word "half" is used loosely, and the two "halves" may in fact be unequal; although they will normally be at least roughly equal in order to use both presses efficiently.)

Preferably the signatures thus fed to the bindery associated with the second press are in a two-up, come and go format.

DESCRIPTION OF THE PREFERRED EMBODIMENT

Figure 1:
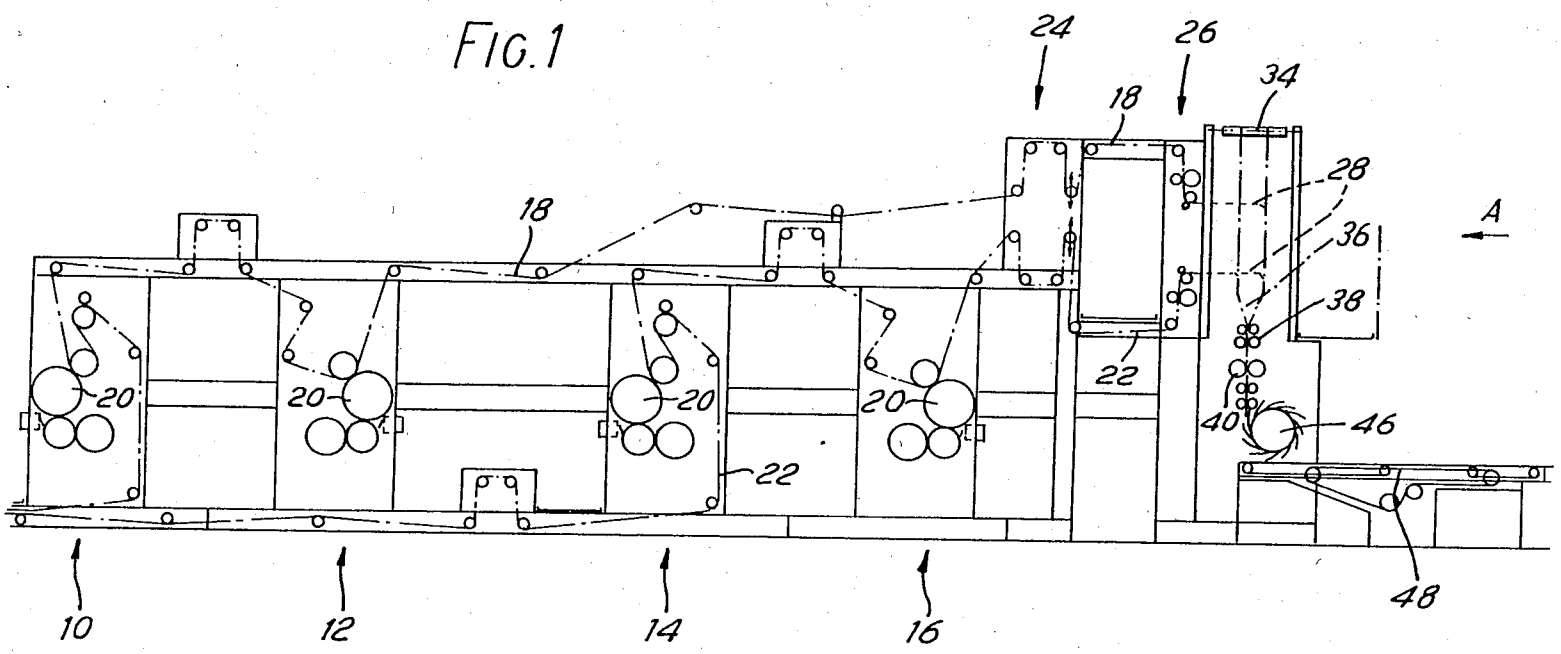
FIG. 1 is a schematic side view of a printing press.

Referring firstly to FIG. 1, the printing press there shown is generally conventional for such book making apparatus, and comprises four printing sections 10,12,14, 16, each having all the cylinders normally associated with web printing, including respective printing cylinders 20. The printing sections 10,12 print on respective sides of a first web 18, while the printing sections 14,16 print on respective sides of a second web 22. After passing through a conventional web alignment and tension compensating section 24, the two webs 18,22 pass into a slitting unit 26. Here, each web is slit longitudinally into six parallel ribbons. The width of each ribbon corresponds to the width of two pages of the books being produced. It will be appreciated that the figure of six ribbons slit from each web is given purely by way of example, and indeed the invention is not limited to presses having two parallel webs such as 18 and 22.

Figure 2:
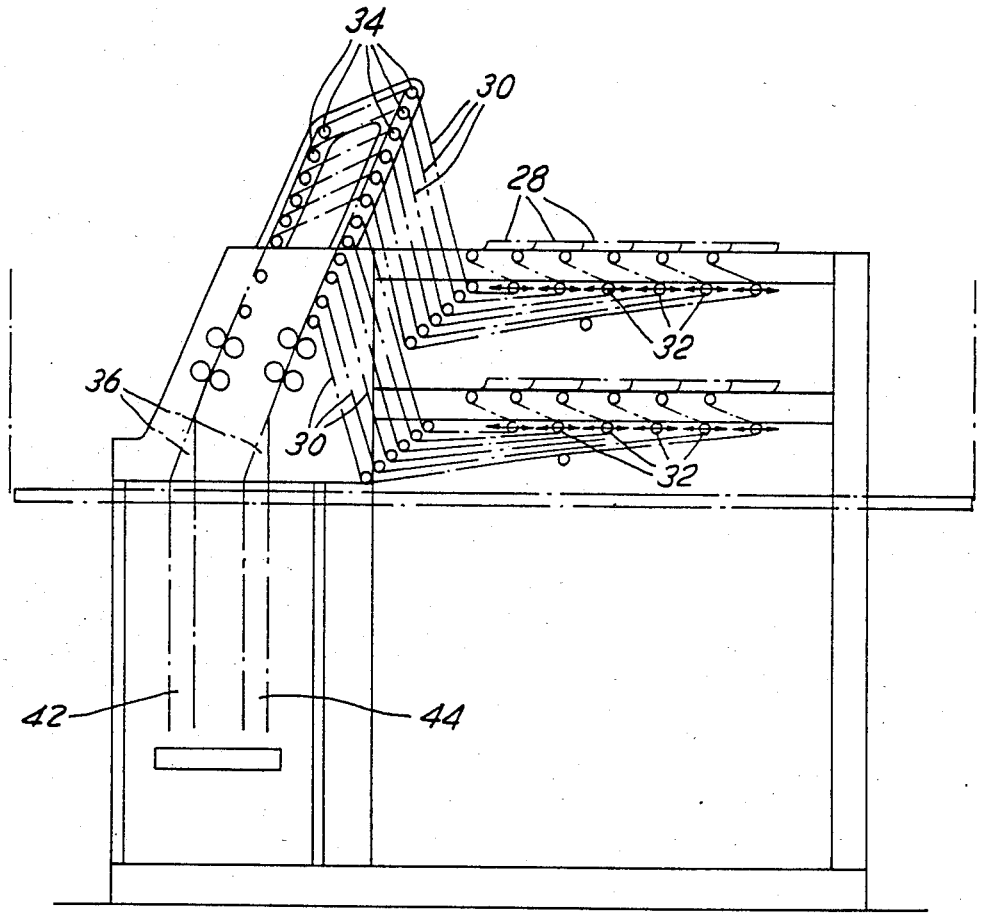
FIG. 2 is a schematic end view of the press, on the line of arrow A in FIG. 1.

As seen in FIG. 1 and (in end view) in FIG. 2 the two sets of six ribbons 30 are next fed over respective sets of six angle bars 28, around movable rolls 32 and guide rolls 34. The effect of the angle bars is that the six ribbons now run one on top of the next, rather than side by side. The movable rolls 32 act to ensure that the ribbons are kept in register with each other. The manner in which the angle bars 28 act to bring the ribbons on top of each other can be seen in more detail from No. GB-A-1473502.

Next, each set of six ribbons passes over a triangular former plate at 36, producing a longitudinal fold in the set of ribbons, which is creased by nip rolls 38 (FIG. 1). The folded sets of ribbons are then cut transversely into individual signatures by cut off cylinders 40. At this time, the signatures formed from the two webs 18,22 are still travelling in two separate, parallel streams 42,44. The reason for this is that with six ribbons produced from each web, it is easier to control the folding operation at the former plates 36 if the output of the two webs is kept separate, rather than if they are combined earlier.

The next step is to collate the signatures into batches, and this is performed by a collating drum 46 which has a plurality of spiral arms forming pockets for receiving successive signatures. The drum 46 lays the signatures in shingled format on a collating conveyor 48, which then collates the shingled signatures into batches, in a generally well known manner. It will be appreciated that there are in fact two conveyors 48 and drums 46, one for each of the streams 42,44.

If desired, other forms of folding, cutting and collating devices can be used, for example those shown in No. GB-A-1473502.

Figure 3:
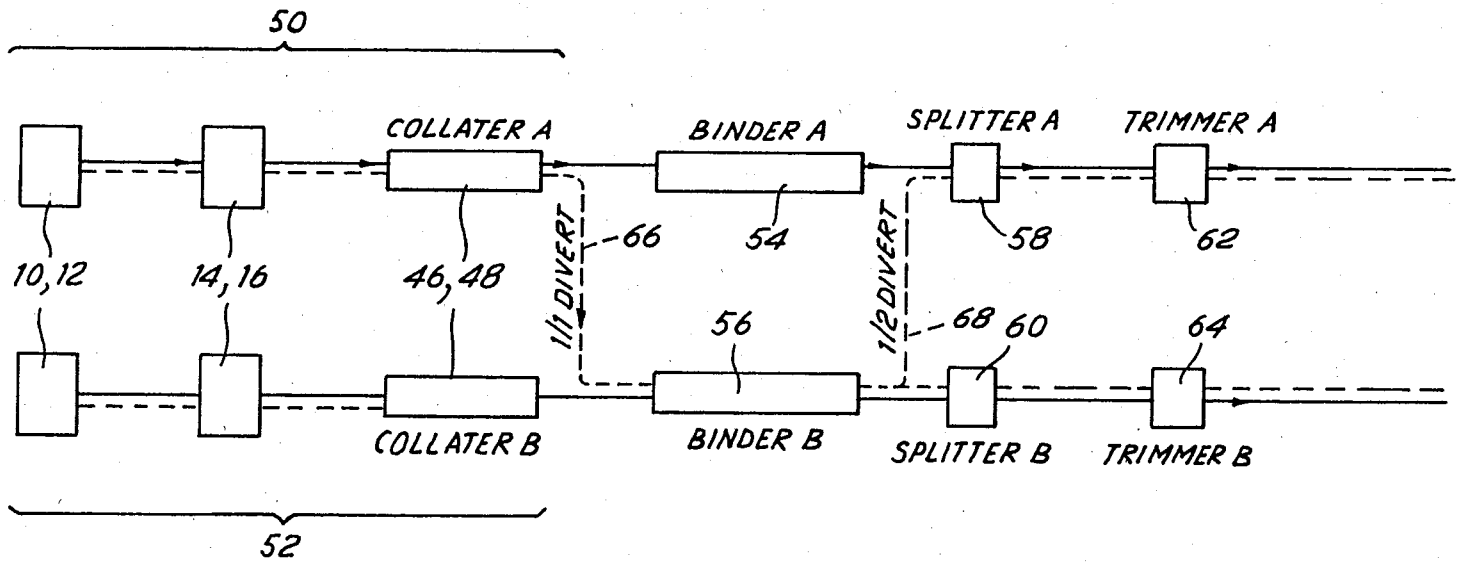
FIG. 3 is a block diagram of apparatus embodying the invention, showing the flow of the process used.

Referring to FIG. 3, there are two parallel printing presses 50,52, each as described above, having printing sections 10,12,14,16 and collating units 46,48. In normal use for books with relatively small numbers of pages, the output of the press 50 is fed to a conventional binder 54 and the output of the press 52 is fed to a corresponding binder 56. Each of the presses 50,52 is normally used in the conventional two-up, come and go arrangement as described in No. GB-A-1473502, and so includes a device to rotate one batch of signatures received from the press through 180° relative to another batch, and then combine the pair of batches, and bind the resulting combined batch.

Each batch thus bound corresponds to two books, and so the outputs of the binders 54,56 are taken to respective splitters 58,60 where the two books of each such pair are sawn apart. Finally, the books pass to respective trimmers 62,64, which are conventional three knife trimmers to trim the top and bottom of the book and the side opposite the spine.

Each of the presses thus has all that is necessary for independent continuous book production, and can operate independently of the other in several, generally conventional ways. For example, each press can produce a book of up to (say) 384 pages in a continuous two-up come and go process, generally as described in No. GB-A-1473502. Again, assuming that the press has a 384 page capacity, it can produce two 192 page books together in a "straight" (that is, not "come and go") process. In this case, of course, the rotation required in the binder for come and go operations is not necessary. Normally, of course, the two books will be identical, and the plates on the printing cylinders 20 corresponding to individual pages of the book will be duplicated. In this way, each of the presses 50,52 and the associated binderies, splitters and trimmers are all working efficiently.

When, with such presses having 384 page capacities, it is desired to produce a book having a larger number of pages (in this example up to 768 pages) the batches of signatures produced by the collator 46,48 of the press 50 are not fed to the binder 54, but are diverted along a path 66. In such a case, the press 50 can be used to produce the first and last quarters of the resulting book, and the press 52 can produce the middle half. The two halves of the book are combined at the entrance to the binder 56. Thus, there are produced combined batches of signatures, of which half the signatures came from press 50 and half came from press 52, which combined batches contain all the pages necessary for making up the complete 768 page book. In binder 56, a combined batch is rotated through 180° and placed face to face with a non-rotated batch; this is the normal come and go operation. The books are then bound as normal by the binder 56.

It would be possible to arrange for the books thus bound (in come and go pairs) to pass directly through the splitter 60 and trimmer 64. However, this would require the splitter 60 and trimmer 64 to be capable of twice the throughput that is necessary when the press 52 is working independently. Accordingly, every alternate book pair is diverted along a path 68, to the splitter 58. The book pairs are split by the splitters 58,60, and trimmed by the trimmers 62,64, in the generally conventional manner.

Figure 4:
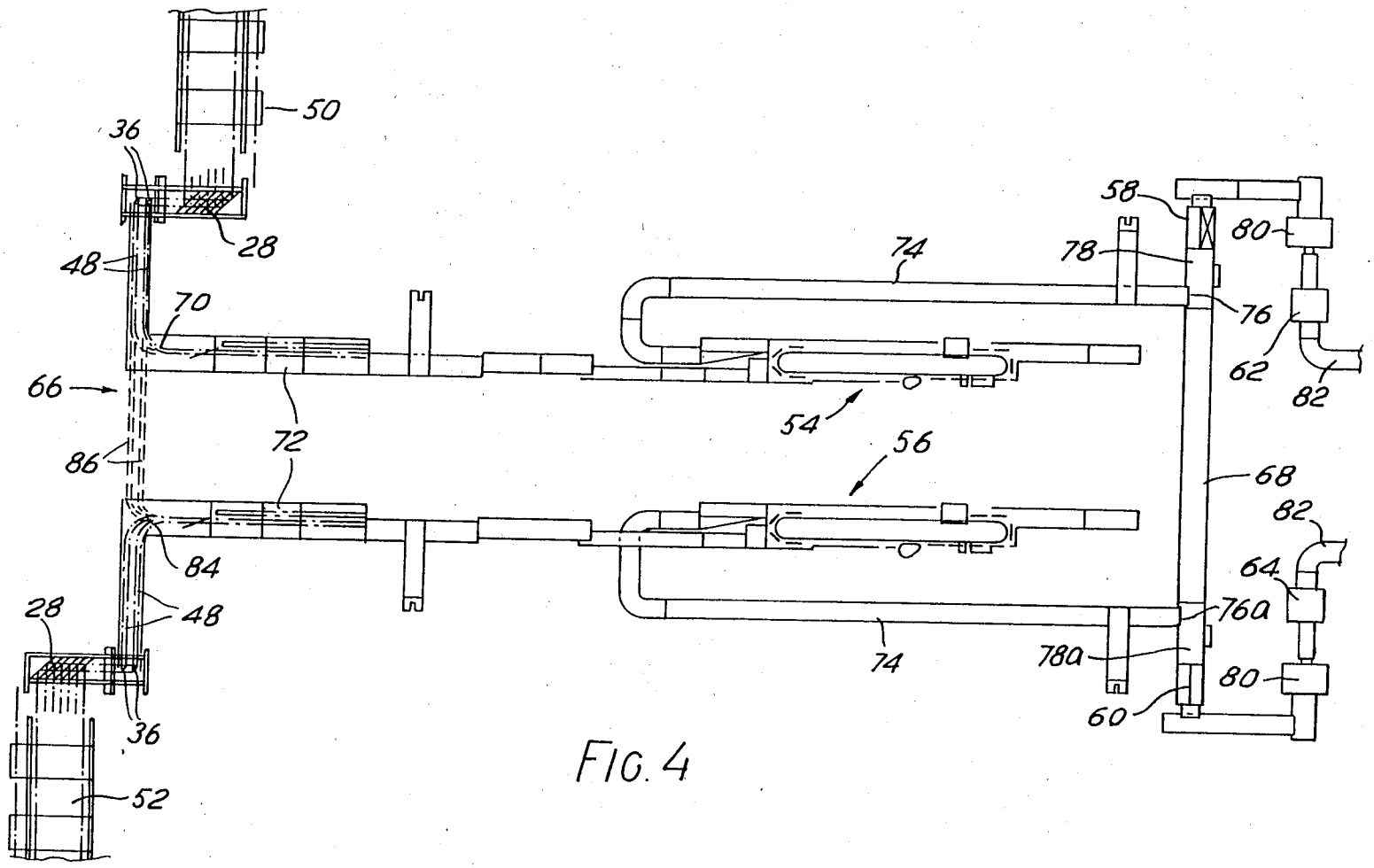
FIG. 4 is a schematic plan view of parts of the apparatus of FIG. 3.

The apparatus just described in relation to FIG. 3 is shown in more detail in FIG. 4. Referring to that figure, there are shown the output ends of the presses 50 and 52, the angle bars 28 of each of these presses, the triangular former plates 36, and for each press, the pair of collating conveyors 48 (one for each of the streams 42,44 of signatures). In normal operation, the conveyors 48 emerging from the press 50 converge at 70, in order to bring together the two streams of signatures 42,44 in the required batches. They then enter a come and go device 72 where batches are rotated through 180° and placed face to face with unrotated batches. Such a come and go device can be as described in No. GB-A-1473502, with the exception that it does not actually form a part of the press 50. Next, the combined come and go batches enter a completely conventional bindery 54, which in the present embodiment is a perfect binder (that is, one in which the fold lines of the signatures are trimmed off so that the individual signatures cannot be identified in the resulting book, and the spine edges of the pages are bound adhesively in book covers—still in come and go pairs).

After passing along a length of conveyor 74 which is provided to allow the adhesive which is applied in the bindery to dry, the books pass over a waterfall at 76 onto a conveyor 78 which takes them laterally through the splitter 58, where they are sawn apart. At the same time, one book of each pair is turned around through 180°, so that all books are in the same orientation.

Next, the books are stacked in piles by a stacker 80, the piles being of suitable height for trimming each pile in the three knife trimmer 62. Finally, the books pass along a conveyor 82 to a packing station The output of the press 52, in normal operation, is dealt with in exactly the same way, and so its description will not be repeated.

When the book to be bound has more than 384 pages, up to 768 in the present example, the collating conveyors 48 of the press 50 are changed over so that they no longer converge at 70. Rather, in order to provide the diverting line 66, they are adjusted so that they continue as two separate streams 86. They are then combined with the conveyor lines 48 from the press 52 at 84, at which point the four lines 48,86 converge and combined batches are made up having a set of signatures from each of the lines 48,86. These are then fed to the come and go device 72 associated with the press 52, to the binder 56, and along the drying line 74 at the output of that binder.

When the resulting bound pairs of books drop over the waterfall 76*a* after this binding process, there is a device which sends alternate book pairs in alternate directions; one along the conveyor 78*a* to the splitter 60, and another along the conveyor 68 to the splitter 58. The splitting and trimming operations are identical to those of the normal operation, except of course that the stacker 80 will stack fewer books in each stack, since the books are naturally thicker.

It will be appreciated that there are other ways of providing the diverting means 66. For example, it would be possible to collate the two output lines 48 of the press 50 at 70, and the two output lines 48 of the press 52 at 84, as normal, and then to send the combined stream from the press 50 along a single conveyor line 66 for combination with the output of the press 52 at the entrance to the come and go device associated with the press 52. It would even be possible (though more difficult) to combine the outputs of the two presses after the respective come and go devices 72. Since the two presses are symmetrically arranged, there is no reason why the output of press 52 should not be diverted to combine with the output of press 50 and pass through the binder 54, rather than as described above. It would be possible to arrange the diverting means 66 such that either of these arrangements were possible, so that the combined outputs of the presses could be passed through the binder 54 or 56 at will. This might be useful if there were ever a breakdown of one of the binders, or simply to even out wear on the binders.

While the invention has been illustrated above with reference to a preferred embodiment it will be understood by those skilled in the art that various changes can be made without departing from the spirit and scope of the invention, and it is intended to cover all such changes by the appended claims.

For example, the two presses may be arranged to produce books of different lengths, so that the length of books produced by diverting and combining the outputs need not be twice that of a book from a single press.

I claim:

1. Apparatus for making books, said apparatus comprising a pair of bookmaking assemblies each comprising: a respective one of first and second printing presses for producing signatures "two up"; a respective bindery for binding the signatures produced by the press into books; a respective splitter downstream of the bindery for splitting a bound batch of signatures into two books; first diverting means having diverting and non-diverting configurations such that in the diverting configuration thereof, the first diverting means acts to divert the output of the first said press and combine that output with the output of the second said press so that the combined output is feedable to the bindery associated with the second press and, in the non-diverting configuration thereof, the first diverting means is inactive and the bookmaking assemblies are independently utilizable; and second diverting means disposed between the bindery of the second press and its respective splitter, said second diverting means being operable to divert a part of the output of the second bindery to the splitter of the first press.

2. Apparatus for making books, said apparatus comprising first and second bookmaking systems disposed in close proximity, said first bookmaking system comprising a first press for producing signatures; a first binary means for, during a first, independent mode of operation thereof, binding the signatures produced by the first press into books; and first means for conveying signatures produced by the first press to the first bindery means; said second bookmaking system comprising a second press for producing signatures; a second bindery means for, during a first, independent mode of operation thereof, binding the signatures produced by the second press into books; and second means for conveying signatures produced by the second press to said second bindery means; and said apparatus further including combining means disposed at a location downstream of said first and second presses, for, during a second, combined mode of operation of said first and second bookmaking systems wherein the number of pages of the book being made is larger than the maximum capacity of a single one of the first and second bookmaking systems, combining the outputs of said first and second presses, said combining means comprising diverting means having diverting and non-diverting configurations such that, in the diverting configuration thereof, the diverting means acts to divert the output of the first press so that the combined output of the two presses is feedable to the bindery means associated with the second press during said combined mode of operation, and, in the non-diverting configuration thereof, the diverting means is inactive and the bookmaking systems are each independently utilizable in the first, independent mode of operation thereof.

* * * * *